US010502088B2

(12) United States Patent
Sebrecht

(10) Patent No.: US 10,502,088 B2
(45) Date of Patent: Dec. 10, 2019

(54) MECHANISM FOR DRIVING MEMBERS FOR ADJUSTING THE ORIENTATION OF BLADES

(71) Applicant: SAFRAN AIRCRAFT ENGINES, Paris (FR)

(72) Inventor: Pierre-Alain Francis Claude Sebrecht, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 302 days.

(21) Appl. No.: 15/508,751

(22) PCT Filed: Sep. 3, 2015

(86) PCT No.: PCT/FR2015/052325
§ 371 (c)(1),
(2) Date: Mar. 3, 2017

(87) PCT Pub. No.: WO2016/034816
PCT Pub. Date: Mar. 10, 2016

(65) Prior Publication Data

US 2017/0260870 A1 Sep. 14, 2017

(30) Foreign Application Priority Data

Sep. 5, 2014 (FR) ..... 14 58344

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2220/323* (2013.01); *F05D 2260/4031* (2013.01); *F05D 2260/53* (2013.01)

(58) Field of Classification Search
CPC ..... F01D 17/162; F04D 29/563; F05D 2220/323; F05D 2260/4031; F05D 2260/53
(Continued)

(56) References Cited

U.S. PATENT DOCUMENTS 5,174,716 A * 12/1992 Hora ..... B64C 11/32 416/129
5,498,135 A * 3/1996 Stallard, III ..... B63H 3/02 416/153
(Continued)

FOREIGN PATENT DOCUMENTS

EP 1 489 267 A1 12/2004
EP 2 053 204 A2 4/2009
(Continued)

OTHER PUBLICATIONS

Search Report issued in French Patent Application No. FR1458344 dated Apr. 30, 2015.
(Continued)

*Primary Examiner* — Syed O Hasan
(74) *Attorney, Agent, or Firm* — Pearne & Gordon LLP

(57) ABSTRACT

A drive mechanism (10) for driving a first adjustment member (12) for adjusting the orientation of the blades (14) of a first turbomachine rectifier stage (16) and a second adjustment member (18) for adjusting the orientation of the blades (20) of a second turbomachine rectifier stage (22), which comprises a mechanism for simultaneously moving the two adjustment members (12, 18) in the turbomachine, characterised in that it comprises a single drive wheel (24) that simultaneously drives the first adjustment member (12) and the second adjustment member (18) and comprises two gear stages (26, 28) that are arranged between the drive wheel (24) and one or the other of the first adjustment
(Continued)

SINGLE FIGURE member (12) and the second adjustment member (18) and that have different transmission ratios.

9 Claims, 1 Drawing Sheet

(58) Field of Classification Search
USPC ..... 416/159, 160, 166, 168 R, 168 A
See application file for complete search history.

(56) References Cited

U.S. PATENT DOCUMENTS

| | | | | |
|---|---|---|---|---|
| 2005/0129510 | A1 | 6/2005 | Raine | |
| 2016/0177775 | A1 * | 6/2016 | Sebrecht | F01D 17/162 415/148 |

FOREIGN PATENT DOCUMENTS

| | | | | |
|---|---|---|---|---|
| EP | 2626521 | * | 2/2013 | 416/468 A |
| EP | 2 626 521 A1 | | 8/2013 | |

OTHER PUBLICATIONS

International Search Report issued in Application No. PCT/FR2015/052325 dated Feb. 2, 2016.
Written Opinion issued in Application No. PCT/FR2015/052325 dated Feb. 2, 2016.

* cited by examiner

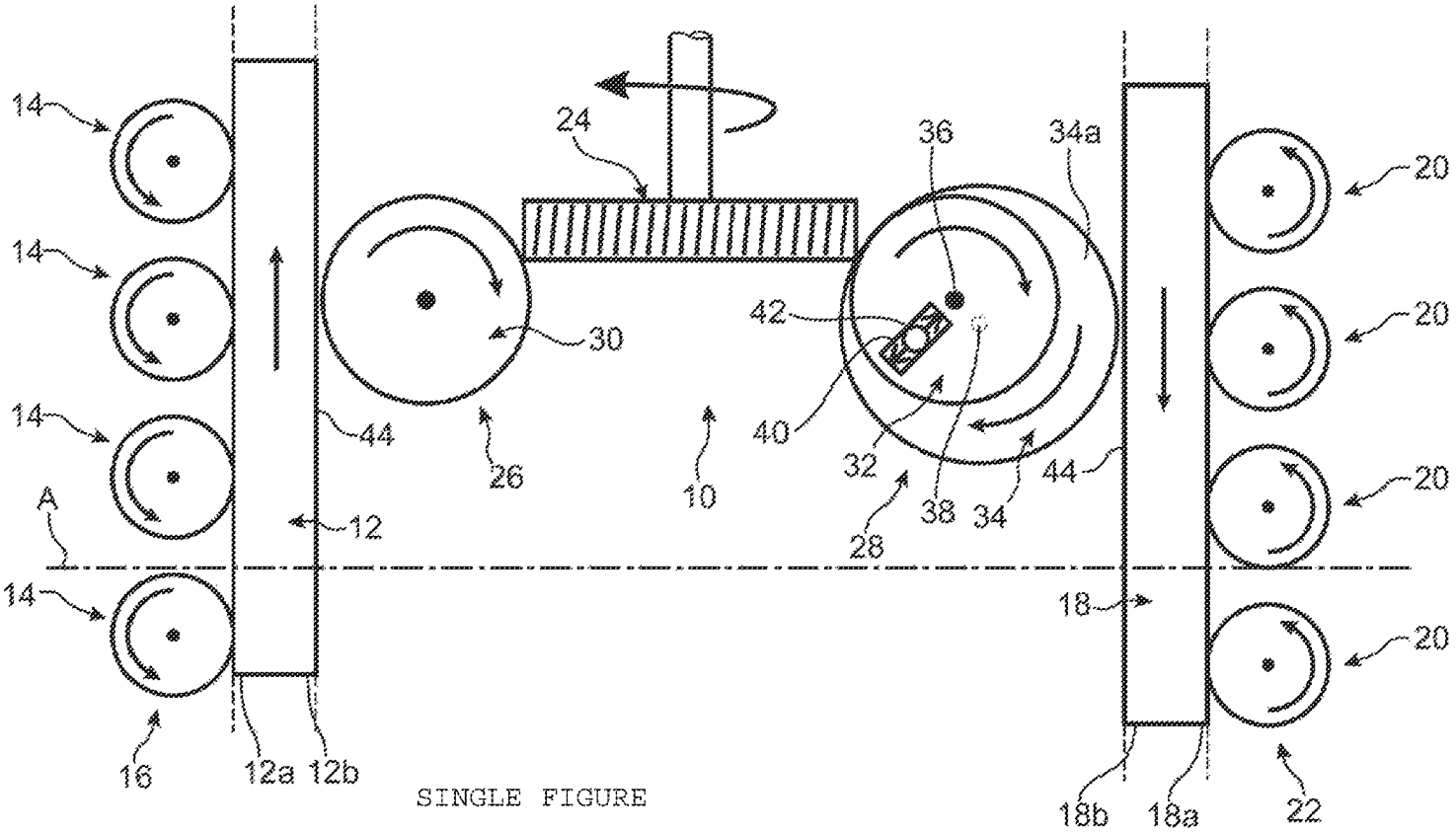
SINGLE FIGURE

MECHANISM FOR DRIVING MEMBERS FOR ADJUSTING THE ORIENTATION OF BLADES

TECHNICAL FIELD

The invention relates to a mechanism for driving members for adjusting the orientation of blades of several turbomachine splitter stages.

The invention more particularly relates to a mechanism for driving two adjustment members enabling both adjustment members to be simultaneously driven with different displacement velocities with respect to each other.

STATE OF PRIOR ART

The compressor and/or the turbine of a turbomachine consist of several stages, each stage including a gas flow splitter.

It is known to modify the orientation of the blades of the splitters as a function of the operating conditions of the turbomachine, to optimise the efficiency thereof.

According to a known embodiment, the modification of the orientation of the blades of the splitter is controlled through an actuator including a control shaft which cooperates with a member associated with each blade or even a control box for controlling the orientation of the blades.

Although the use of a single shaft for driving the blades of both splitter stages enables the number of components to be limited in the turbomachine, the bulk of this system is particularly high, which requires to favour this solution with respect to turbomachines having great dimensions.

The use of a control box is suitable for any turbomachine size. However, this solution includes great number of components, which reduces the system accuracy because of the cumulative clearances between the numerous components and their respective deformations.

The purpose of the invention is to provide a mechanism for driving the means for adjusting the orientation of the blades which is both space-saving and includes a reduced number of pieces.

DISCLOSURE OF THE INVENTION

The invention provides a mechanism for driving a first adjustment member for adjusting the orientation of the blades of a first turbomachine splitter stage and a second adjustment member for adjusting the orientation of the blades of a second turbomachine splitter stage, which includes means for simultaneously driving both adjustment members into movement in the turbomachine, characterised in that it includes a single drive wheel which simultaneously drives the first adjustment member and the second adjustment member and includes two gear stages which are arranged between the drive wheel and either of the first adjustment member and the second adjustment member and which have different transmission ratios.

Such a drive mechanism enables the functions of driving and variability of the transmission ratios to be concentrated into a reduced number of components, thus reducing the mass of the drive mechanism.

Preferably, the transmission ratio of the gear stage associated with the second adjustment member varies as a function of the angular position of the drive wheel in the turbomachine.

Preferably, the gear stage associated with the second adjustment member includes a first toothed wheel which is engaged with the drive wheel, a second toothed wheel which is engaged with a toothed portion of the second adjustment member and matting means for matting both wheels with each other to vary the transmission ratio of the gear stage.

Preferably, the gear stage associated with the second adjustment member is made to vary the transmission ratio of the gear stage in a non-linear manner.

Preferably, the axes of rotation of both wheels of the gear stage associated with the second adjustment member are parallel and offset with respect to each other.

Preferably, one of both wheels includes a groove and the other wheel includes a finger axially protruding from said other wheel, the finger being accommodated in the groove and being able to cooperate with the groove to transmit a torque from the first wheel to the second wheel.

Preferably, the groove is formed in the first toothed wheel and the finger is carried by the second toothed wheel.

Preferably, the gear stage associated with the first adjustment member includes a third toothed wheel which is engaged with the drive wheel and a complementary toothed portion of the first adjustment member.

The invention also relates to an aircraft turbomachine including two splitter stages the orientation of the blades of which can be modified, characterised in that each splitter stage includes a member for adjusting the orientation of the blades of said splitter stage, both adjustment members being rotatably movable in the turbomachine about the main axis of the turbomachine and being rotatably driven by a drive mechanism according to the invention.

Preferably, each adjustment member includes a first toothed portion associated with the gear stage associated therewith and a second toothed portion which meshes with a toothed wheel carried by each blade of the splitter stage associated therewith.

BRIEF DESCRIPTION OF THE DRAWINGS

Further characteristics and advantages of the invention will appear upon reading the detailed description that follows for the understanding of which reference will be made to the appended FIGURES among which the single FIGURE is a schematic representation of a drive mechanism made in accordance with the invention.

DETAILED DISCLOSURE OF PARTICULAR EMBODIMENTS

In the single FIGURE, is represented a mechanism 10 for driving a member 12 for adjusting the orientation of the blades 14 of a first turbomachine splitter stage 16 and a member 18 for adjusting the orientation of the blades 20 of a second turbomachine splitter stage 22.

The members 12, 18 for adjusting the orientation of the blades 14, 20 each consist of a ring associated with each splitter stage 16, 22, which is rotatably movable in the turbomachine about the main axis of the turbomachine (not represented). An axial end 12*a*, 18*a* of each ring 12, 18 includes a toothed portion which cooperates with a toothed wheel carried by each blade 14, 20.

Thus, the rotation of a ring 12, 18 in the turbomachine causes the simultaneous rotation of all the blades 14, 20 of the splitter stage 16, 22 associated therewith.

During a change in the operating conditions of the turbomachine, the orientation of the blades 14, 20 of both splitter stages 16, 22 should be simultaneously modified to optimise the turbomachine performance. Thus, the blades 14 of the first splitter stage 16 pivot by an angle different with respect to the pivoting angle of the blades 20 of the second splitter stage 22.

The mechanism 10 for driving the adjustment rings 12, 18 is designed to simultaneously drive both rings 12, 18 into movement and such that the displacement amplitude of the first ring 12, associated with the first splitter stage 16, is different from the displacement amplitude of the second ring 18 which is associated with the second splitter stage 22.

For the simultaneous driving of both rings 12, 18, the drive mechanism 10 includes a single drive wheel 24 which is mated with both rings 12, 18 through two gear stages 26, 28.

The first gear stage 26 is associated with the first ring 12 of the first splitter stage 16 and it includes a single toothed wheel 30 which is engaged with the drive wheel 24 and with the first ring 12.

The second gear stage 28 is associated with the second ring 18 and it includes a first toothed wheel 32 which is engaged with the drive wheel 24 and a second toothed wheel 34 which is engaged with the second ring 18. Both toothed wheels of the second gear stage 28 cooperate with each other to transmit driving efforts from the first toothed wheel 32 to the second toothed wheel 34.

The second axial end 12*b*, 18*b* of each ring 12, 18 includes to that end a toothed portion 44 which cooperates with the wheel 30, 34 of the first gear stage 26 or the second gear stage 28 associated therewith.

The first wheel 32 and the second wheel 34 are mated to each other to provide a transmission ratio different from the transmission ratio provided by the toothed wheel 30 of the first gear stage 26.

Here, the transmission ratio provided by the toothed wheel 30 of the first gear stage 26 is linear and is constant regardless of the angular position of the drive wheel 24. The transmission ratio provided by the second gear stage 28 is thus not linear.

According to a preferred embodiment, the transmission ratio of the second gear stage 28 is variable and it varies as a function of the angular position of the drive wheel 24, and thus of the first wheel 32.

The first wheel 32 and the second wheel 34 are arranged in parallel to each other and their respective axes of rotation 36, 38 are parallel and radially offset from each other. Both wheels 32, 34 are mated by means for varying the transmission ratio of the second gear stage 28.

This mating means here consist in a groove 40 and tracking finger 42 assembly each of which is respectively carried by either of the first or the second wheel 32, 34.

Here, the groove 40 is formed in the first wheel 32 and it is of a radial main orientation with respect to the axis 36 of rotation of the first wheel 32. The finger 42 is carried by the second wheel 34, by axially protruding with respect to a radial face 34*a* of the second wheel 34 facing the first wheel 32 and it is accommodated in the groove 40.

Since the respective axes of rotation 36, 38 of both wheels 32, 34 are offset from each other, during the rotation of the first wheel 32, the finger 42 is displaced in the groove 40, thus modifying the distance between the finger 42 and the axis of rotation 36 of the first wheel 32. The transmission ratio is thereby modified.

It will be understood that the invention is not limited to this single configuration of the groove 40 and of the finger 42 and that the groove 40 may not be rectilinear, to achieve a given law defining the transmission ratio of the second gear stage 28.

Further, according to the embodiment represented, the axis of rotation of the drive wheel 24 is overall perpendicular to the axes of rotation 36, 38 of the wheels 30, 32, 34 of the gear stages 26, 28. According to an alternative embodiment, the axes of rotation of the different wheels 24, 30, 32, 34 are parallel.

The turbomachine (not represented) including the splitter stages 16, 22 and the drive mechanism 10 defined above is thus of a simpler structure.

What is claimed is:

1. A drive mechanism for driving a first adjustment member for adjusting an orientation of a first set of blades of a first turbomachine splitter stage and a second adjustment member for adjusting an orientation of a second set of blades of a second turbomachine splitter stage, which includes means for simultaneously driving both first and second adjustment members into movement in a turbomachine, wherein the drive mechanism includes a single drive wheel which simultaneously drives the first adjustment member and the second adjustment member and includes a first gear stage and a second gear stage which are arranged between the drive wheel and either of the first adjustment member and the second adjustment member and which have different transmission ratios, and wherein the transmission ratio of the second gear stage associated with the second adjustment member varies as a function of an angular position of the drive wheel in the turbomachine.

2. The drive mechanism according to claim 1, wherein the second gear stage associated with the second adjustment member includes a first toothed wheel which is engaged with the drive wheel, a second toothed wheel which is engaged with a toothed portion of the second adjustment member, and mating means for matting both wheels with each other to vary the transmission ratio of the second gear stage.

3. The drive mechanism according to claim 2, wherein the second gear stage associated with the second adjustment member is made to vary the transmission ratio of the gear stage in a non-linear manner.

4. The drive mechanism according to claim 3, wherein axes of rotation of both wheels of the second gear stage associated with the second adjustment member are parallel and offset with respect to each other.

5. The drive mechanism according to claim 4, wherein one of both wheels includes a groove and the other wheel includes a finger axially protruding from said other wheel, the finger being accommodated in the groove and being able to cooperate with the groove to transmit a torque from the first wheel to the second wheel.

6. The drive mechanism according to claim 5, wherein the groove is formed in the first toothed wheel and the finger is carried by the second toothed wheel.

7. The drive mechanism according to claim 1, wherein the first gear stage associated with the first adjustment member includes a toothed wheel which is engaged with the drive wheel and a complementary toothed portion of the first adjustment member.

8. An aircraft turbomachine including two splitter stages the orientation of the blades of which can be modified, wherein each splitter stage includes an adjustment member for adjusting the orientation of the blades of said splitter stage, both adjustment members being rotatably movable in the turbomachine about a main axis of the turbomachine and being rotatably driven by a drive mechanism according to claim 1.

9. The turbomachine according to claim 8, wherein each adjustment member includes a first toothed portion associated with the first gear stage or second gear stage associated therewith and a second toothed portion which meshes with a toothed wheel carried by each blade of the first splitter stage or second splitter stage associated therewith.

* * * * *